US012808225B1

(12) United States Patent
Zhang

(10) Patent No.: US 12,808,225 B1
(45) Date of Patent: Nov. 24, 2026

(54) ROTARY TENT CENTER HUB

(71) Applicant: Yunfeng Zhang, Hangzhou (CN)

(72) Inventor: Yunfeng Zhang, Hangzhou (CN)

( * ) Notice: Subject to any disclaimer, the term of this patent is extended or adjusted under 35 U.S.C. 154(b) by 0 days.

(21) Appl. No.: 19/533,381

(22) Filed: Feb. 9, 2026

(51) Int. Cl.
*E04H 15/50* (2006.01)
*E04H 15/48* (2006.01)

(52) U.S. Cl.
CPC ..... *E04H 15/48* (2013.01); *E04H 15/50* (2013.01)

(58) Field of Classification Search
CPC ..... E04H 15/50
See application file for complete search history.

(56) References Cited

U.S. PATENT DOCUMENTS 10,060,153 B2 * 8/2018 Song ..... E04H 15/34
10,107,005 B2 * 10/2018 Song ..... E04H 15/44
10,273,711 B2 * 4/2019 Song ..... E04H 15/48
10,982,464 B2 * 4/2021 Ying ..... E04H 15/44
11,002,036 B1 * 5/2021 Zhang ..... E04H 15/48
11,821,228 B2 * 11/2023 Sun ..... E04H 15/60
2023/0064601 A1 * 3/2023 Liu ..... E04H 15/50

* cited by examiner

*Primary Examiner* — Noah C. Hawk
(74) *Attorney, Agent, or Firm* — Nicholas Makridakis

(57) ABSTRACT

A rotary tent center hub is provided, including a tent frame, an upper connecting seat, and a lower hinge seat. A hinge rod is received in a lower interior portion of the upper connecting seat, a locking pin is fixedly mounted in a lower end of the hinge rod, an inner locking sleeve is rotatably received in a lower interior portion of the lower hinge seat, and a locking groove is machined through an outer surface of the inner locking sleeve. A connecting plate is fixed to a bottom of the lower hinge seat by multiple bolts, an outer locking sleeve is rotatably received by a lower interior portion of the connecting plate, a spring is fixedly received in a lower interior portion of the outer locking sleeve, and a locking plate is fixedly disposed at a upper end of the spring.

6 Claims, 10 Drawing Sheets

ROTARY TENT CENTER HUB

TECHNICAL FIELD

The present disclosure relates to the technical field of tent hub, and in particular to a rotary tent center hub.

BACKGROUND

Folding tents, also known as advertising tents or sun shelters, are detachable portable facilities commonly used for outdoor exhibitions, promotional events, celebrations, trade shows, tourism and leisure, field operations, food stalls, and similar scenarios. Their structural design and material craftsmanship continue to evolve. The tent center hub is a core component used for quickly securing and deploying tents. It ensures stability and minimizes shaking by locking the center pole and support structure.

Most existing folding tents utilize a push-button unlocking mechanism, which often involves a relatively complex overall structure, typically requiring multiple linkages, latches, and other transmission components. In actual use, users must press a specific location precisely to trigger the unlock function. However, the required pressing force is difficult to grasp—if too light, fail to unlock; if too heavy, it may easily damage the mechanism. Especially in outdoor environments, and when operating with one hand, with wet or slippery hands, in low light, or while wearing gloves, this operation method proves rather inconvenient. It not only affects the user experience but also reduces the efficiency of tent setup and takedown.

Therefore, a rotary tent center hub has been developed by those skilled in the art to resolve the problems mentioned above.

SUMMARY

Given the shortcomings of existing technologies, the present disclosure aims to provide a rotary tent center hub. By rotating the lower locking seat, the tent frame can be quickly deployed and locked or folded and unlocked without the need for additional tools. This improves the efficiency of deploying and storing the tent frame, facilitates the assembly, disassembly, and maintenance of various components, and effectively extends the overall service life of the device.

To achieve the above objectives, the present disclosure adopts the following technical solutions.

A rotary tent center hub, comprising: a tent frame, an upper connecting seat, and a lower hinge seat; wherein a hinge rod is received in a lower interior portion of the upper connecting seat, a locking pin is fixedly mounted in a lower end of the hinge rod, an inner locking sleeve is rotatably received in a lower interior portion of the lower hinge seat, and a locking groove is machined through an outer surface of the inner locking sleeve;

A connecting plate is fixed to a bottom of the lower hinge seat by multiple bolts, an outer locking sleeve is rotatably received by a lower interior portion of the connecting plate, a spring is fixedly received in a lower interior portion of the outer locking sleeve, and a locking plate is fixedly disposed at a upper end of the spring.

Further, an external part of the locking pin is positioned within the locking groove, and an upper external part of the locking plate is slidably disposed in a lower internal part of the inner locking sleeve.

Further, an lower external part of the locking plate is slidably disposed in the lower interior portion of the outer locking sleeve, and an upper end of the locking plate is disposed under the lower end of the hinge rod.

Further, a screw is threaded into the upper connecting seat, and a middle portion of the screw is disposed inside the upper end of the hinge rod.

Further, the lower locking seat is fixedly connected to the lower end of the outer locking sleeve by bolting, and an outer surface of the lower locking seat is fixedly provided with an anti-slip protrusion.

Further, an inner lower end of the hinge rod is received in a lower interior portion of the inner locking sleeve, and an upper part of the outer locking sleeve is disposed in the lower internal part of the lower hinge seat.

Further, an outer surface of the lower hinge seat and an outer surface of the upper connecting seat are both pivotally connected to an upper central portion of the tent frame, and the locking plate has an inverted T-shape.

The present disclosure has the following beneficial effects:

The rotary tent center hub provided by the present disclosure operates as follows for deploying and locking the tent frame: first, insert the lower end of the hinge rod into the interior of the lower hinge seat, allowing the locking pin to simultaneously enter the interior of the inner locking sleeve and slide to a set position. Then, rotate the lower locking seat counterclockwise. This rotation drives the outer locking sleeve to turn synchronously, which in turn drives the internal locking plate to rotate. The locking plate further drives the inner locking sleeve to rotate, causing the locking groove on the inner locking sleeve to turn accordingly. Finally, the locking pin engages into the locking groove, completing the deployment and locking of the tent frame. The entire operation process is relatively simple, requires no additional tools, and improves the efficiency of tent setup and storage.

Figure 1:
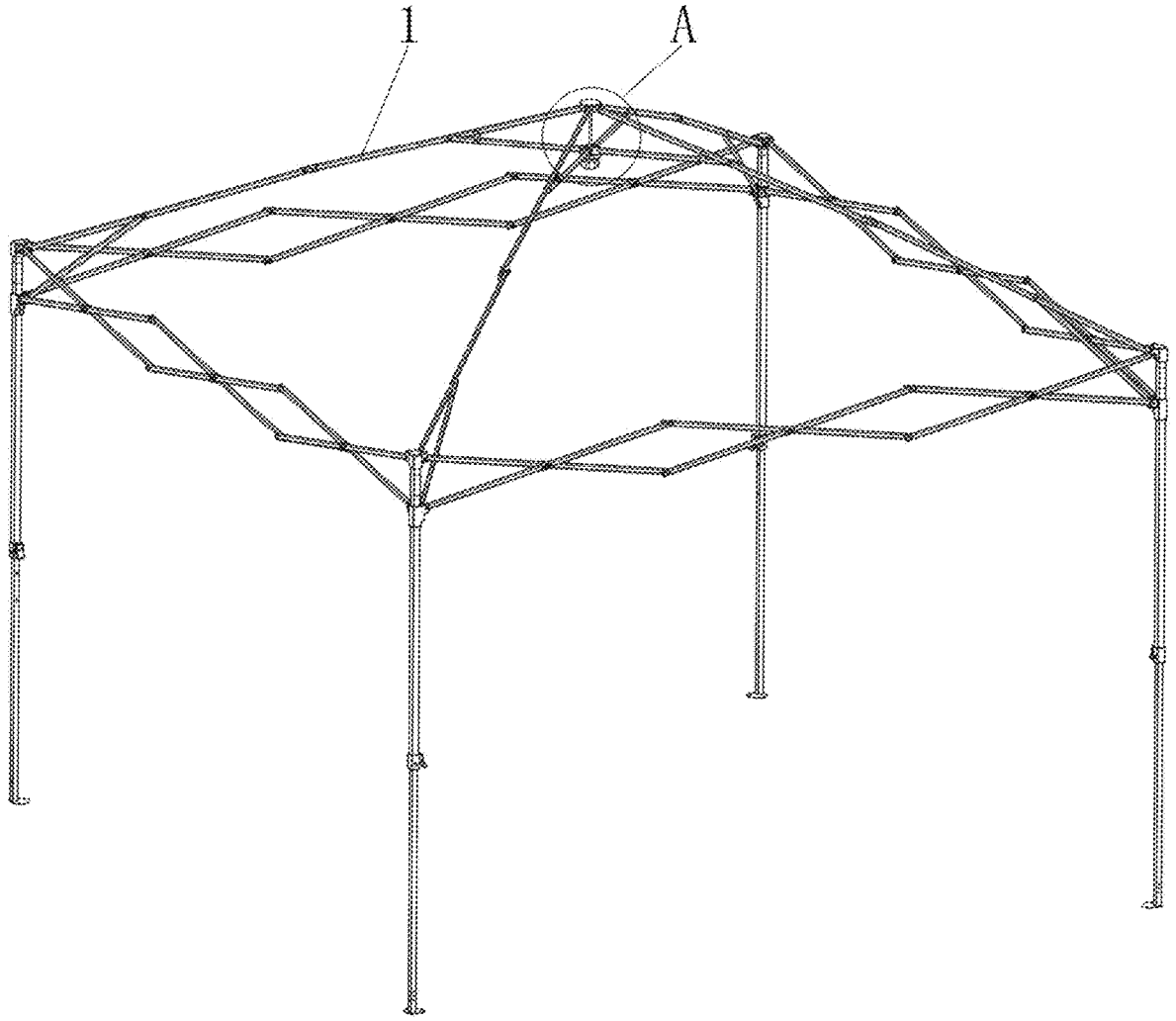
FIG. 1 shows an axonometric view of the overall structure of the present disclosure.

In the drawings, reference numerals are as follows.

1. Tent frame, 2. Upper connecting seat, 3. Hinge rod, 4. Lower hinge seat, 5. Lower locking seat, 6. Screw, 7. Connecting plate, 8. Inner locking sleeve, 9. Outer locking sleeve, 10. Spring, 11. Locking plate, 12. Locking groove, 13. Locking pin.

DETAILED DESCRIPTION OF THE EMBODIMENTS

To make the objectives, technical solutions, and advantages of the rotary tent center hub of the present disclosure more clear and understandable, the following will provide a further detailed explanation in conjunction with accompanying drawings and embodiments. It should be understood that the specific embodiments described herein are solely for illustrative purposes of the rotary tent center hub of the present disclosure and are not intended to limit the present disclosure.

The following will provide a detailed description of the specific implementation of the rotary tent center hub of the present disclosure in conjunction with specific embodiments.

Figure 2:
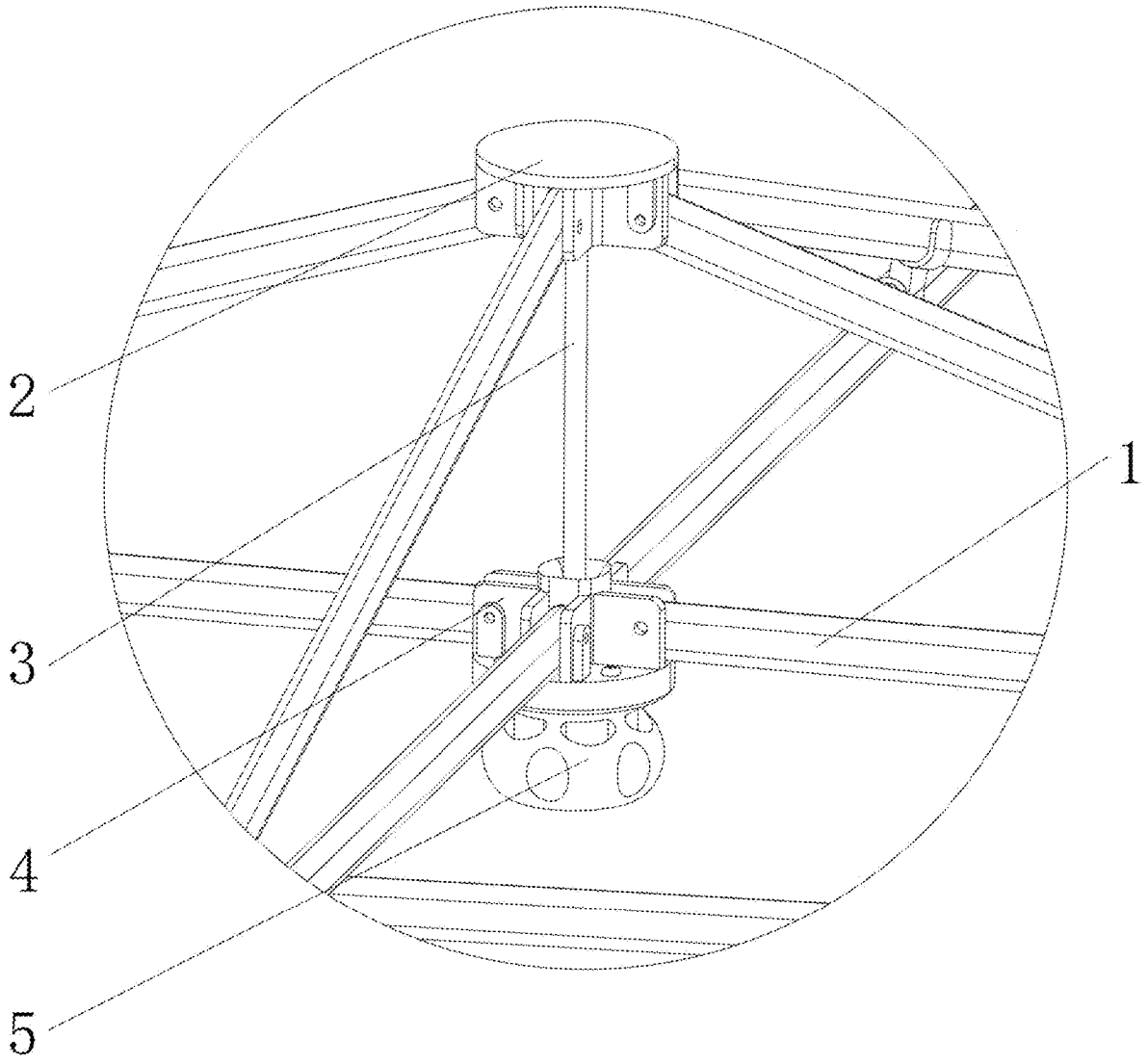
FIG. 2 shows an enlarged view of area A in FIG. 1 of the present disclosure.
Figure 3:
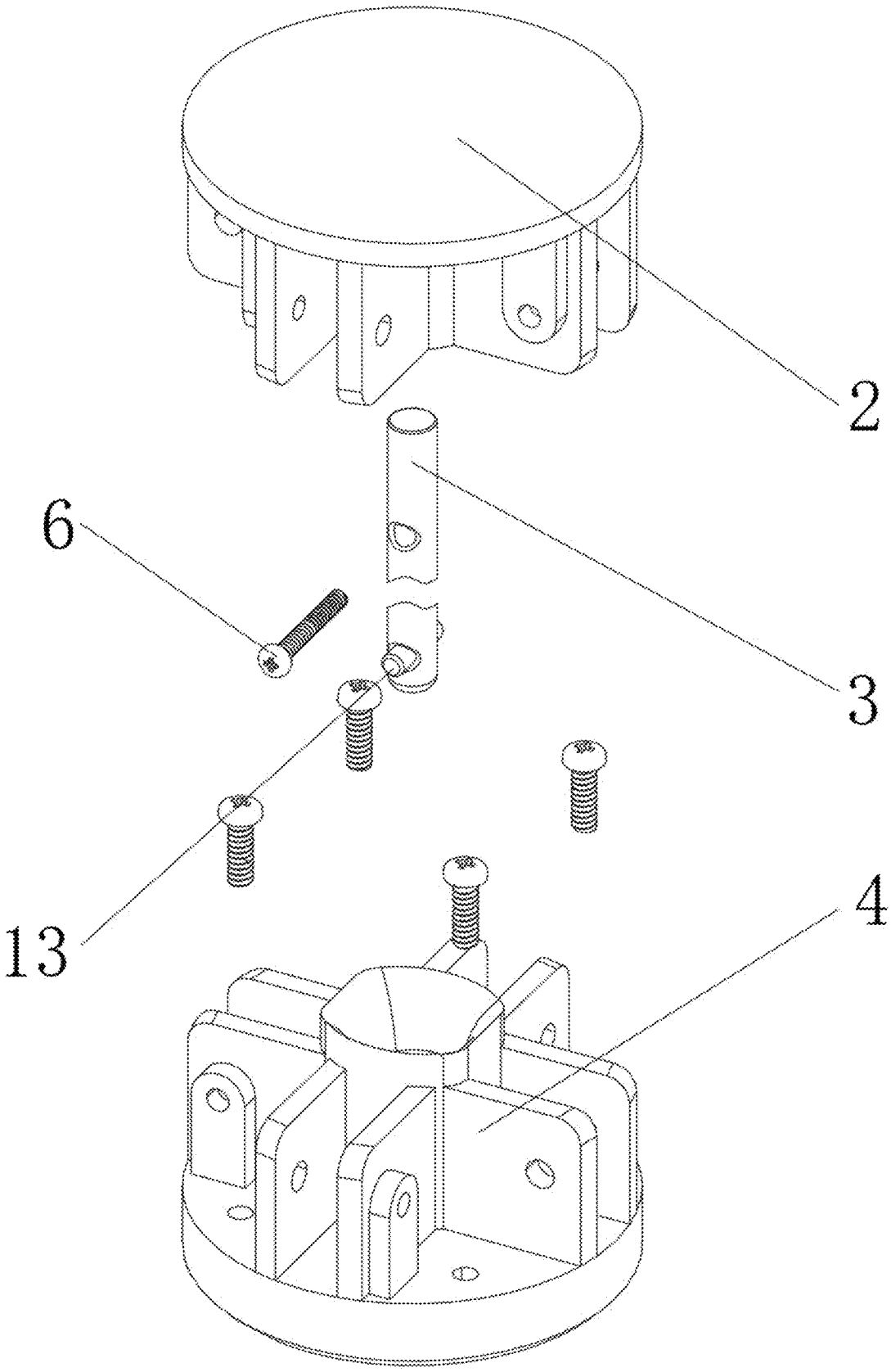
FIG. 3 shows a partial exploded axonometric view near the locking pin of the present disclosure.
Figure 4:
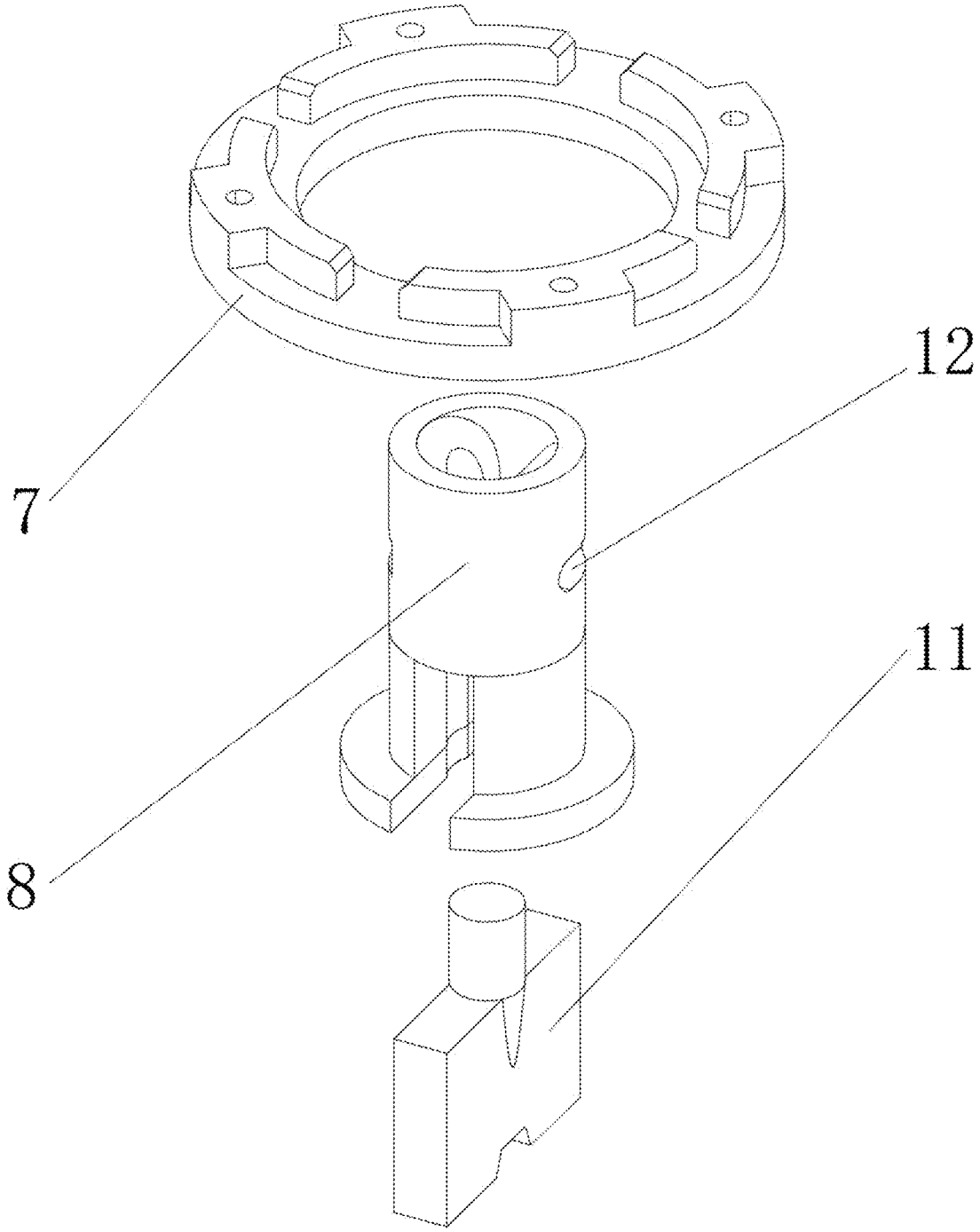
FIG. 4 shows an exploded axonometric view near the locking groove of the present disclosure.
Figure 5:
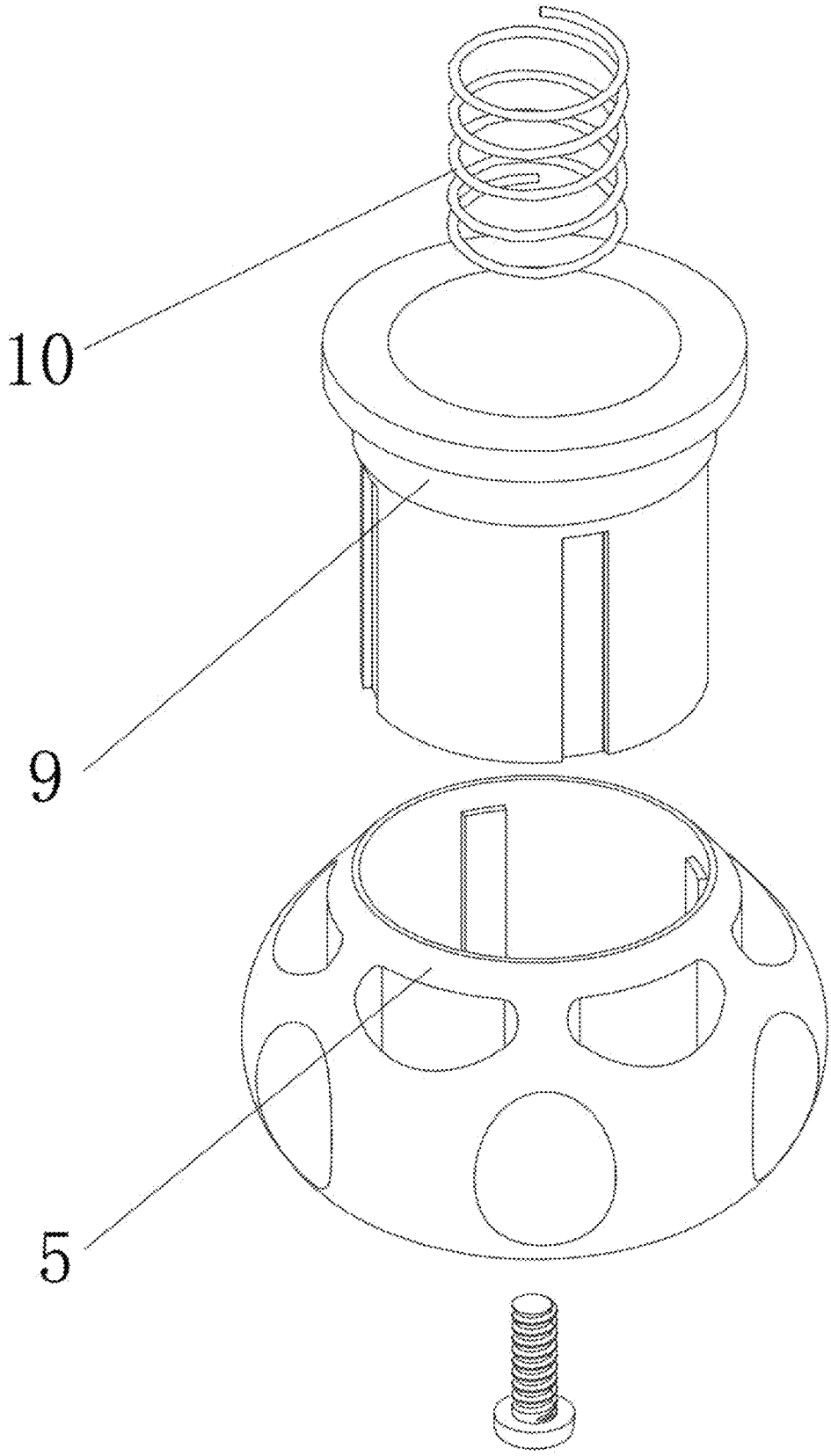
FIG. 5 shows an exploded axonometric view near the spring of the present disclosure.
Figure 6:
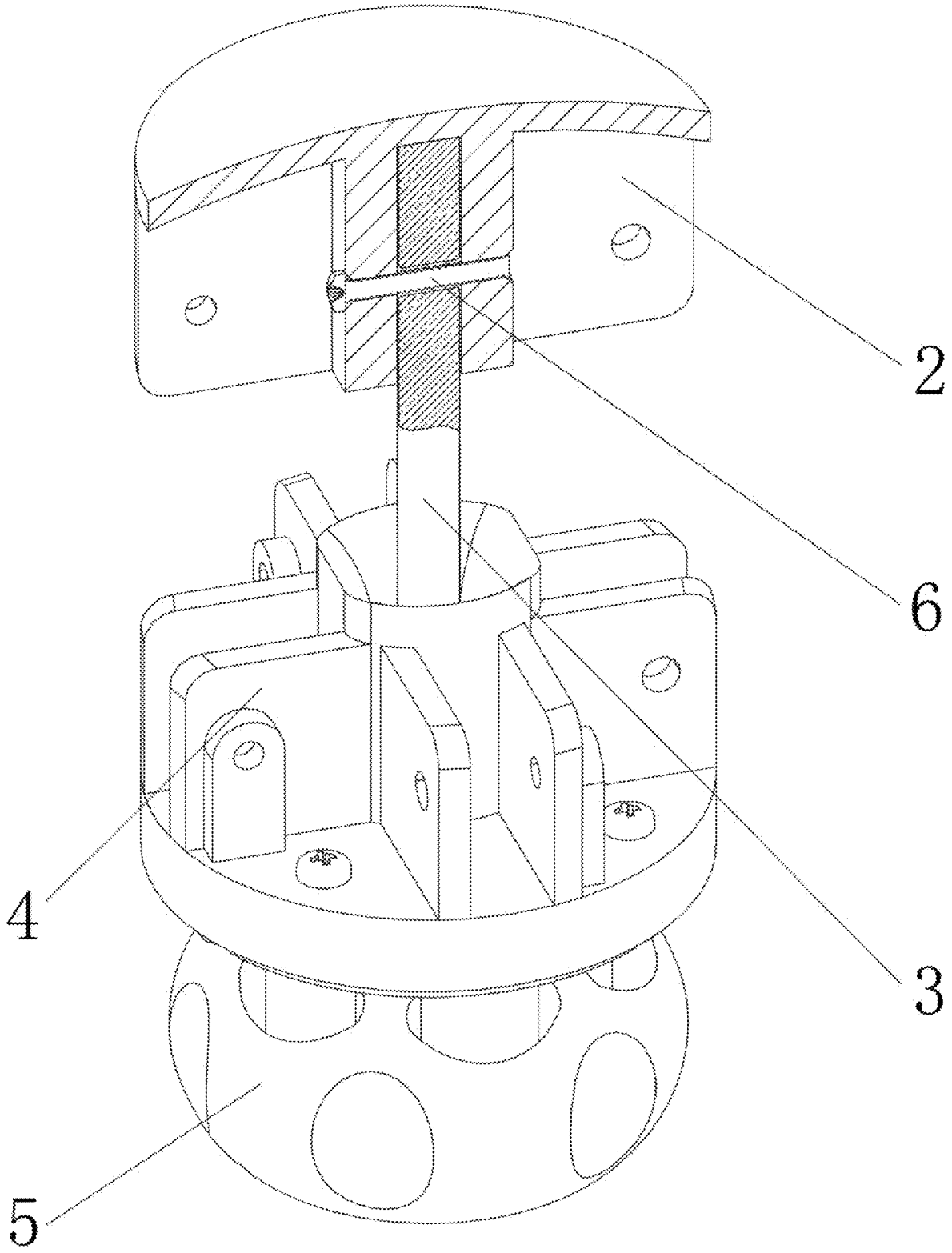
FIG. 6 shows a partial front sectional axonometric view near the upper connecting seat of the present disclosure.
Figure 7:
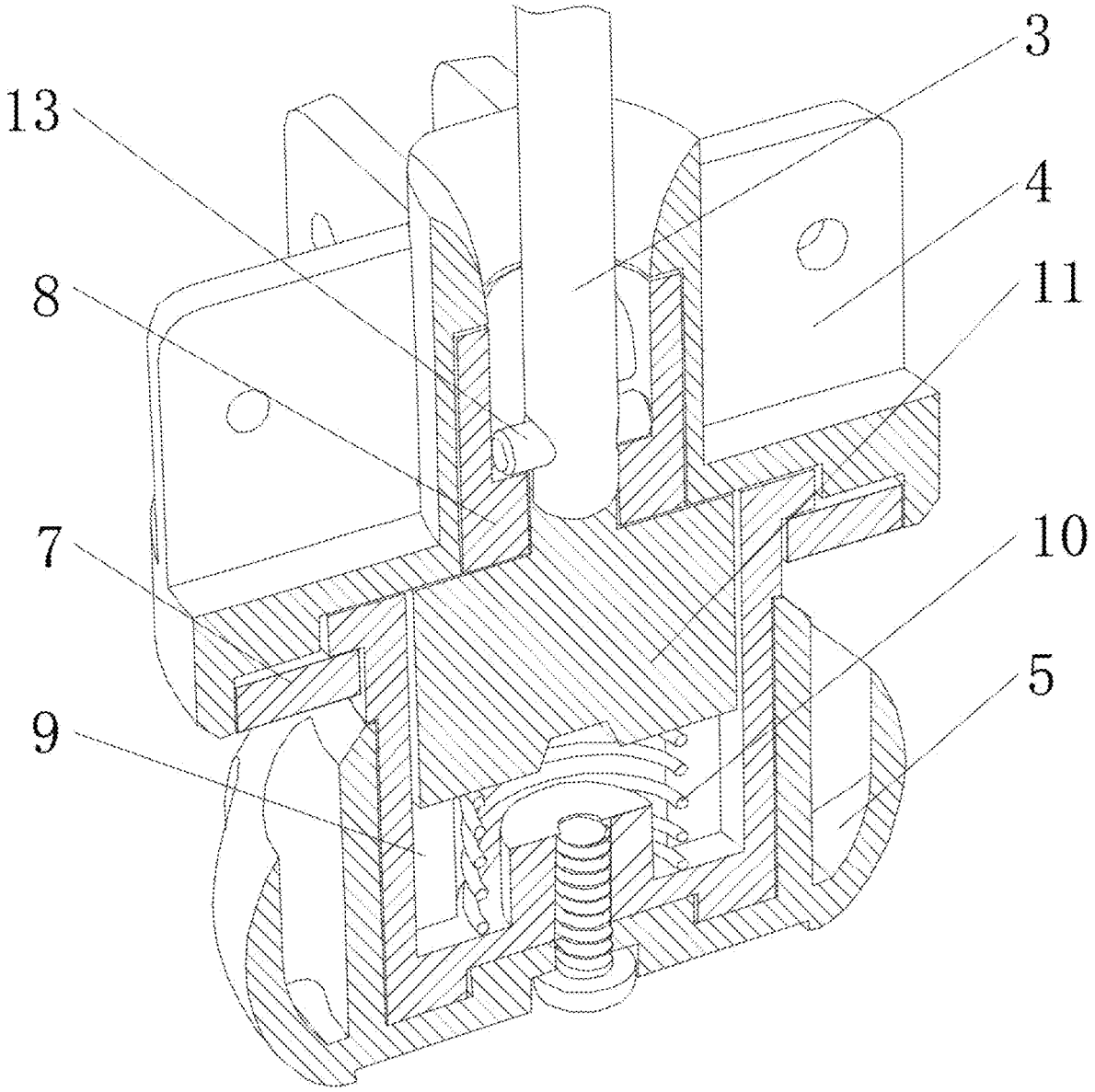
FIG. 7 shows a partial front sectional axonometric view near the locking plate of the present disclosure.
Figure 8:
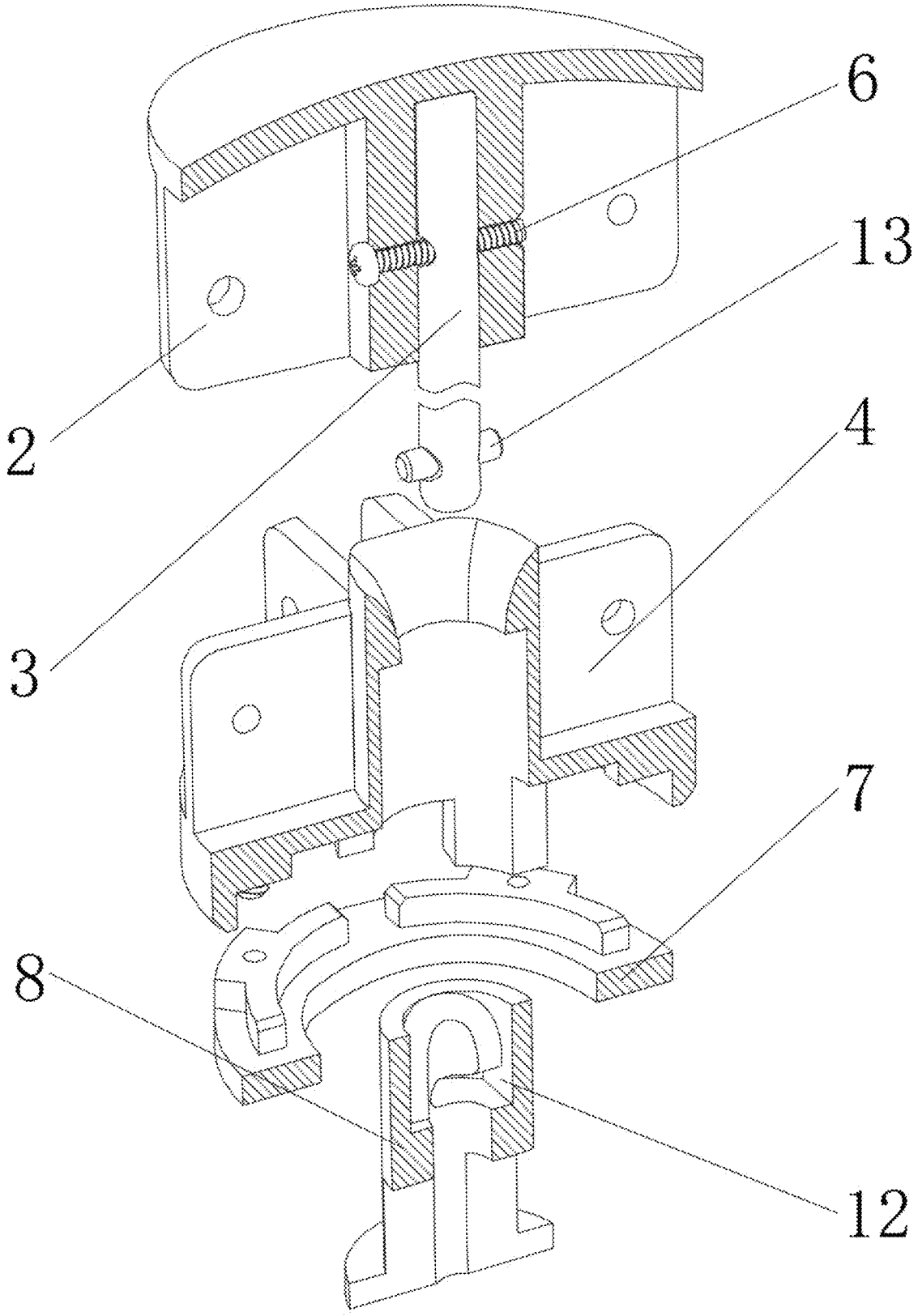
FIG. 8 shows a front sectional exploded axonometric view near the locking groove of the present disclosure.
Figure 9:
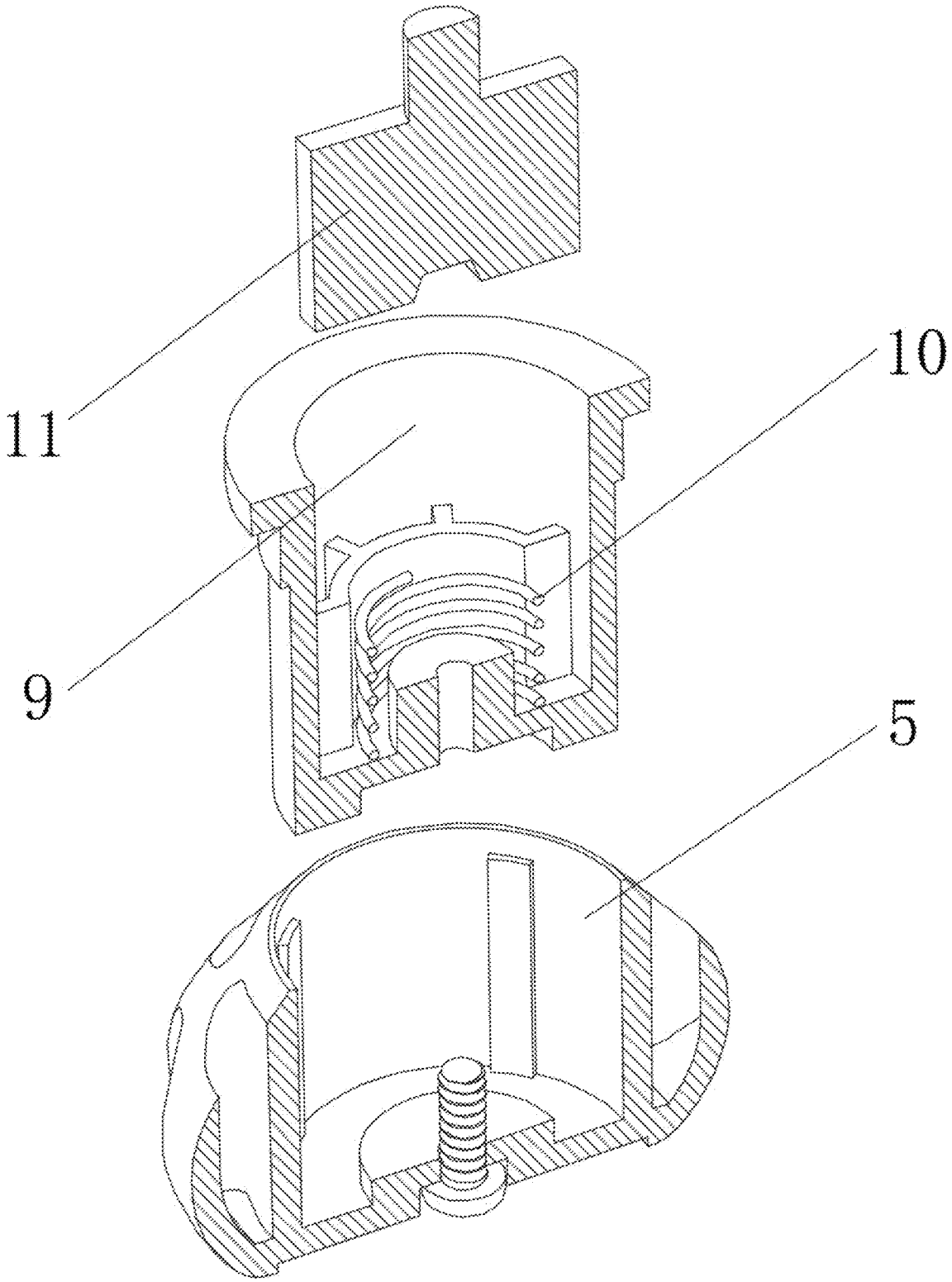
FIG. 9 shows a front sectional exploded axonometric view near the locking plate of the present disclosure.
Figure 10:
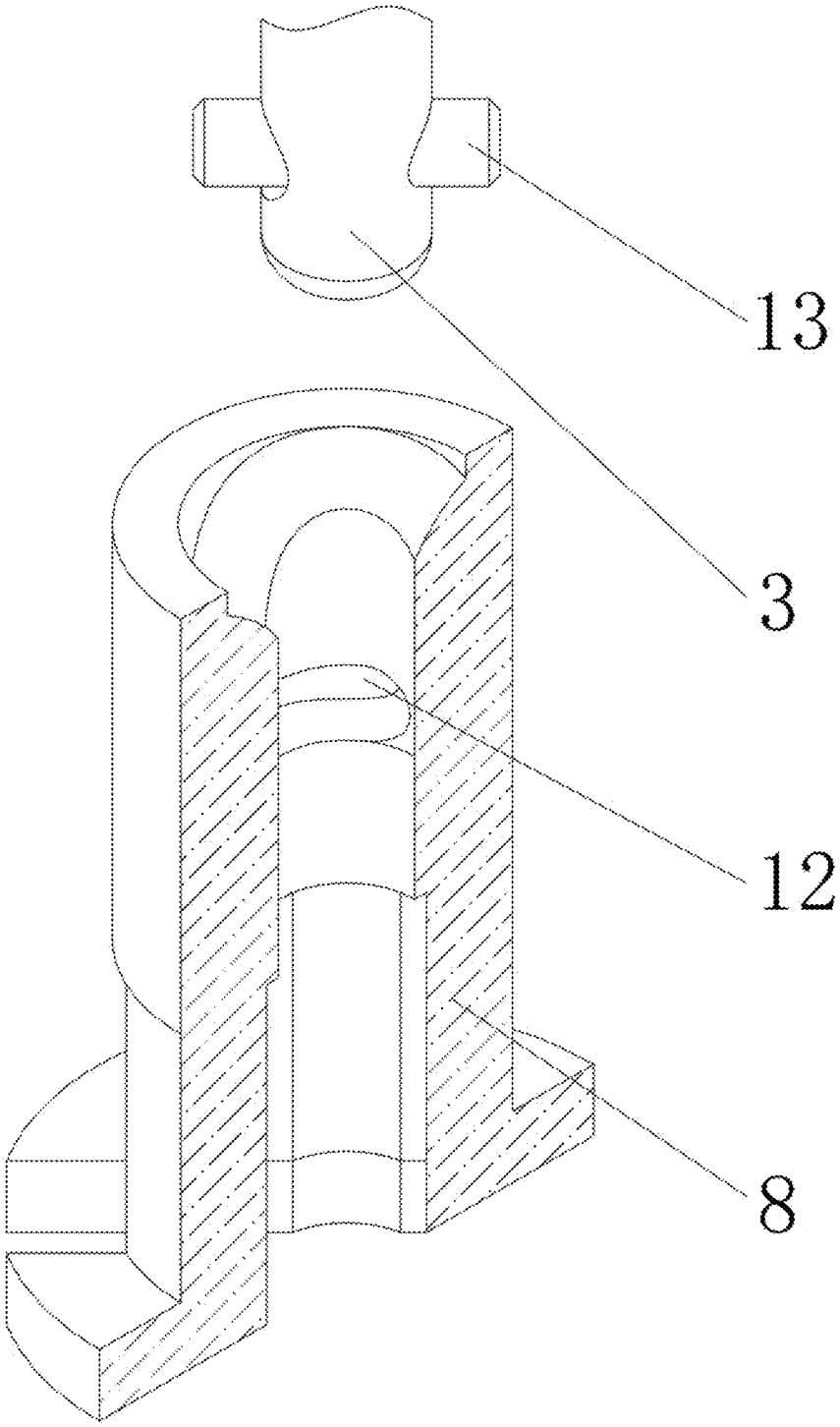
FIG. 10 shows a partial front sectional exploded axonometric view near the locking pin of the present disclosure.

Referring to FIGS. 1-10, an embodiment of the disclosure provided herein including:

A rotary tent center hub, including: a tent frame 1, an upper connecting seat 2, and a lower hinge seat 4, and a hinge rod 3 is received in a lower interior portion of the upper connecting seat 2, a locking pin 13 is fixedly mounted in a lower end of the hinge rod 3, an inner locking sleeve 8 is rotatably received in a lower interior portion of the lower hinge seat 4, and a locking groove 12 is machined through an outer surface of the inner locking sleeve 8;

A connecting plate 7 is fixed to a bottom of the lower hinge seat 4 by multiple bolts, an outer locking sleeve 9 is rotatably received by a lower interior portion of the connecting plate 7, a spring 10 is fixedly received in a lower interior portion of the outer locking sleeve 9, and a locking plate 11 is fixedly disposed at a upper end of the spring 10;

An external part of the locking pin 13 is positioned within the locking groove 12, and an upper external part of the locking plate 11 is slidably disposed in a lower internal part of the inner locking sleeve 8; an lower external part of the locking plate 11 is slidably disposed in the lower interior portion of the outer locking sleeve 9, and an upper end of the locking plate 11 is disposed under the lower end of the hinge rod 3; a screw 6 is threaded into the upper connecting seat 2, and a middle portion of the screw 6 is disposed inside the upper end of the hinge rod 3;

The lower locking seat 5 is fixedly connected to the lower end of the outer locking sleeve 9 by bolting, and an outer surface of the lower locking seat 5 is fixedly provided with an anti-slip protrusion; an inner lower end of the hinge rod 3 is received in a lower interior portion of the inner locking sleeve 8, and an upper part of the outer locking sleeve 9 is disposed in the lower internal part of the lower hinge seat 4; an outer surface of the lower hinge seat 4 and an outer surface of the upper connecting seat 2 are both pivotally connected to an upper central portion of the tent frame 1, and the locking plate 11 has an inverted T-shape.

Specifically, prior to use, first, pivotally connect the upper central portion of the tent frame 1 to the outer surface of the upper connecting seat 2. Next, align the upper end of the hinge rod 3 with the interior of the upper connecting seat 2 and insert the hinge rod 3 to the set position. Then, the operator passes the screw 6 through the mounting hole formed at the upper end of the hinge rod 3, and then, tighten screw 6 to the upper connecting seat 2, thereby the upper connecting seat 2 and the hinge rod 3 are fixedly connected.

Next, align the lower interior portion of the inner locking sleeve 8 with the upper external part of the locking plate 11 and insert it; then align the lower interior portion of the lower hinge seat 4 with the installed inner locking sleeve 8 and insert it, allowing the inner locking sleeve 8 to slide within the lower hinge seat 4. When the inner locking sleeve 8 slides to its final position, make the upper outer surface of the outer locking sleeve 9 is received in the interior of the connecting plate 7, and position the upper part of the connecting plate 7 at the lower interior portion of the lower hinge seat 4. Then, use bolts through the mounting hole at the upper part of the lower hinge seat 4 into the threaded hole at the upper part of the connecting plate 7, then tighten them sequentially. Then, align the lower locking seat 5 with the lower external part of the outer locking sleeve 9 and insert it. Next, use bolts through the mounting holes in the center of the lower end of the lower locking seat 5, threading them into the threaded holes at the lower interior part of the outer locking sleeve 9. Finally, pivotally connect the lower central portion of the tent frame 1 to the outer surface of the installed lower hinge seat 4.

When unfolding the tent frame 1, the operator inserts the lower end of the hinge rod 3 into the lower hinge seat 4. Then, the locking pin 13 on the exterior of the hinge rod 3 enters the inner locking sleeve 8 and sliding into its interior. At this point, the operator rotates the lower locking seat 5 counterclockwise, which in turn drives outer locking sleeve 9 that fixedly connected to it to rotate. Since the lower external part of the locking plate 11 is up-and-down slidably mounted within the outer locking sleeve 9, and the upper external part of the locking plate 11 is up-and-down slidably mounted in the lower interior part of the inner locking sleeve 8, the rotation of the outer locking sleeve 9 will drive the spring 10 and the locking plate 11 inside it to rotate synchronously. The rotation of the locking plate 11 will drive the inner locking sleeve 8 to rotate, thereby causing the locking groove 12 inside the inner locking sleeve 8 to rotate. Finally causing the locking pin 13 to rotate and engage within the locking groove 12, thereby completing the unfolding of the tent frame 1. After finish locking, the locking plate 11, driven by the force of spring 10, keeps its upper end permanently positioned beneath the lower end of the hinge rod 3, effectively preventing structural loosening or accidental unlocking.

When folding the tent frame 1, the operator holds the lower locking seat 5 and turns it clockwise to release the connection between the locking pin 13 and the locking groove 12. Subsequently, the tent frame 1 can be folded. This operation is convenient. Furthermore, each component employs a step-by-step insertion and bolted connection method, making disassembly and assembly simple and facilitating transportation, replacement, or maintenance.

It should be specifically noted that: Tent frame 1 is a device existing in the related art or achievable by the related art. Its functions, specific composition, and principles are clear to those skilled in the art and will not be described in detail herein.

The locking plate 11 has an inverted T-shape. Its upper external part forms a clearance fit with the rectangular groove at the lower part of the inner locking sleeve 8, enabling circumferential torque transmission. Simultaneously, the lower part of its longitudinal segment is fixedly connected to the upper end of the spring 10. The preload of spring 10 is transmitted through its transverse segment to the inner locking sleeve 8, ensuring stable engagement between the inner locking sleeve 8 and the locking pin 13. Furthermore, the corresponding interior position of the outer locking sleeve 9 features a rectangular groove for matching a flat surface of the locking plate 11. The clearance fit between the flat surface and rectangular groove forms a circumferential stop, ensuring that when the outer locking sleeve 9 rotates, locking plate 11 is driven to rotate synchronously through this engagement, preventing relative slippage.

The spring 10 is a cylindrical helical compression spring and is fixedly disposed at the lower part of the locking plate 11. Its core function is to continuously apply upward axial thrust for locking plate 11, ensuring the upper end of the locking plate 11 remains tightly pressed against the lower surface of hinge rod 3 to generate axial preload. Preventing disengagement between the locking pin 13 and the locking groove 12 due to vibration during tent use. It also provides the force for the unlocked locking plate 11 to return to its original position. The spring 10 is made of stainless steel, offering excellent fatigue strength to effectively prevent spring failure caused by excessive compression or stretching, while also avoiding corrosion that could affect its elasticity.

The locking pin 13 has a cylindrical structure with an arc-shaped chamfer at its end for smooth insertion guidance into the inner locking sleeve 8. The locking groove 12 has an arc-shaped channel, with its curvature matching the outer arc of the locking pin 13. This ensures the locking pin 13 cannot radially disengage after engagement. The locking pin 13 and locking groove 12 have a clearance fit, guaranteeing stability after locking while preventing difficult unlocking due to insufficient clearance.

The connecting plate 7 is fixedly provided with a ring-shaped boss at its upper part. The outer diameter of the ring-shaped boss forms a transition fit with the inner diameter of the lower part of the lower hinge seat 4. After being embedded into the lower part groove of the lower hinge seat 4, it is secured by bolts evenly distributed around the circumference. A stepped bore is provided in the middle section of the connecting plate 7, with its upper bore segment supporting the upper part of the outer locking sleeve 9. The bore wall and outer surface of the outer locking sleeve 9 have a clearance fit, providing a stable rotational support surface for the outer locking sleeve 9 and preventing eccentric wobbling during rotation.

Rectangular blocks are fixedly evenly disposed around the inner wall of the lower locking seat 5 circumferentially. Corresponding locating rectangular grooves are formed on the lower part surface of the outer locking sleeve 9. The rectangular grooves engage with the rectangular blocks. After the rectangular block is inserted into the rectangular groove, the lower locking seat 5 and outer locking sleeve 9 are secured by the center bolt, ensuring no relative circumferential displacement between them. The outer surface of the lower locking seat 5 is provided with an evenly distributed axial anti-slip protrusion, and the lower locking seat 5 is designed for easy one-handed operation. Additionally, the lower end surface of the lower locking seat 5 have corresponding markings and an arrow direction to guide operation.

The screw 6 is a hex socket head cap screw. Its threaded portion is fitted with a lock washer. When the screw 6 is tightened, the lock washer compresses, utilizing elastic restoring force to prevent screw loosening due to vibration. The upper end of the hinge rod 3 is provided with an axial stop step that abuts against the internal step surface of the upper connecting seat 2, which limits the insertion depth of the hinge rod 3, and ensuring precise alignment between the locking pin 13 and the inner locking sleeve 8.

All standard components used in this disclosure are commercially available. Custom parts can be manufactured according to the specifications and drawings provided. Specific connection methods of each part employ established techniques such as bolts, rivets, welding, and other conventional means. Mechanical components, parts, and equipment utilize standard models within the existing technology. Therefore, detailed descriptions are omitted. Any content not detailed in this specification constitutes prior art known to those skilled in the art.

How it works: After the tent frame 1 is fully unfolded, the operator rotates the lower locking seat 5 by its outer surface's anti-slip protrusion. This action drives the outer locking sleeve 9 to rotate synchronously, causing the locking plate 11 to drive the inner locking sleeve 8 to rotate synchronously. At this point, the locking pin 13 fixed inside the lower end the hinge rod 3 precisely aligns with and engages into the locking groove 12 on the inner locking sleeve 8, thus achieving full locking of the tent frame 1. After locking, the upper end of the locking plate 11 remains in contact with the lower end of the hinge rod 3 by spring force of spring 10, forming axial positioning to effectively prevent loosening.

Secondly, when need to fold the tent, the operator rotates the lower locking seat 5 clockwise, driving the outer locking sleeve 9 to turn. This causes the locking plate 11 to rotate the inner locking sleeve 8, gradually disengaging the locking groove 12 on the inner locking sleeve 8 from the locking pin 13 on the hinge rod 3. Then, the locking pin 13 will release from the interior of the locking groove 12. At this point, the hinge rod 3 can be taken out from the interior portion of the lower hinge seat 4, thereby releasing the lock on the tent frame 1 and facilitating the tent's storage.

The above is only some embodiments of the present disclosure and is not intended to limit the present disclosure. Any modifications, equivalent substitutions, and improvements made within the concept and principles of the present disclosure shall be included in the scope of protection of the present disclosure.

What is claimed is:

1. A rotary tent center hub, comprising: a tent frame, an upper connecting seat, and a lower hinge seat;

wherein a hinge rod is received in a lower interior portion of the upper connecting seat, a locking pin is fixedly mounted in a lower end of the hinge rod, an inner locking sleeve is rotatably received in a lower interior portion of the lower hinge seat, and a locking groove is machined through an outer surface of the inner locking sleeve;

wherein a connecting plate is fixed to a bottom of the lower hinge seat by multiple bolts, an outer locking sleeve is rotatably received by a lower interior portion of the connecting plate, a spring is fixedly received in a lower interior portion of the outer locking sleeve, and a locking plate is fixedly disposed at a upper end of the spring;

wherein an lower external part of the locking plate is slidably disposed in the lower interior portion of the outer locking sleeve, and an upper end of the locking plate is disposed under the lower end of the hinge rod.

2. The rotary tent center hub of claim 1, wherein an external part of the locking pin is positioned within the locking groove, and an upper external part of the locking plate is slidably disposed in a lower internal part of the inner locking sleeve.

3. The rotary tent center hub of claim 1, wherein a screw is threaded into the upper connecting seat, and a middle portion of the screw is disposed inside the upper end of the hinge rod.

4. The rotary tent center hub of claim 1, wherein the lower locking seat is fixedly connected to the lower end of the outer locking sleeve by bolting, and an outer surface of the lower locking seat is fixedly provided with an anti-slip protrusion.

5. The rotary tent center hub of claim 1, wherein an inner lower end of the hinge rod is received in a lower interior portion of the inner locking sleeve, and an upper part of the outer locking sleeve is disposed in the lower internal part of the lower hinge seat.

6. The rotary tent center hub of claim 1, wherein an outer surface of the lower hinge seat and an outer surface of the upper connecting seat are both pivotally connected to an upper central portion of the tent frame, and the locking plate has an inverted T-shape.

* * * * *